US005423638A

United States Patent [19]

Merriman

[11] Patent Number: 5,423,638

[45] Date of Patent: Jun. 13, 1995

[54] MINE ROOF SUPPORTS

[75] Inventor: Colin G. M. Merriman, Leyland, England

[73] Assignee: Gullick Dobson Limited, Lancashire, England

[21] Appl. No.: 208,045

[22] Filed: Mar. 9, 1994

Related U.S. Application Data

[63] Continuation of Ser. No. 961,181, Oct. 16, 1992, abandoned.

[30] Foreign Application Priority Data

Oct. 18, 1991 [GB] United Kingdom ..... 9122146

[51] Int. Cl.[6] ..... E02D 23/00

[52] U.S. Cl. ..... 405/292; 33/1 N; 33/354; 405/291; 405/302

[58] Field of Search ..... 405/291–297, 405/302; 33/1 N, 1 H, 354, 391

[56] References Cited

U.S. PATENT DOCUMENTS

| | | | |
|---|---|---|---|
| 2,613,449 | 10/1952 | Eisley | 33/1 N |
| 3,672,174 | 6/1972 | Van Hippel | 299/1.7 X |
| 3,945,128 | 3/1976 | Weiss | 33/391 X |
| 4,156,971 | 6/1979 | Currie et al. | 33/1 N X |
| 4,222,686 | 9/1980 | Bell et al. | 405/291 X |
| 4,887,935 | 12/1989 | Hoppers et al. | 405/291 X |
| 4,913,499 | 4/1990 | Smart | 33/1 H X |

FOREIGN PATENT DOCUMENTS

| | | | |
|---|---|---|---|
| 2235235A | 2/1991 | United Kingdom . | |
| 2245632A | 1/1992 | United Kingdom . | |
| 0723128 | 3/1980 | U.S.S.R. | 33/1 H |

*Primary Examiner*—Dennis L. Taylor
*Attorney, Agent, or Firm*—Nixon & Vanderhye

[57] ABSTRACT

A mine roof support having means for monitoring the angles made by the canopy 11 and the base 10 with respect to a datum. The angular information may be gathered in a number of different ways and the information used to control subsequent movements of the support.

21 Claims, 5 Drawing Sheets

MINE ROOF SUPPORTS

This is a continuation of application Ser. No. 07/961,181, filed Oct. 16, 1992, now abandoned.

The invention relates to mine roof supports, which typically comprise a floor engaging base, a roof engaging canopy, and jack means extending between the base and the canopy to urge the canopy into contact with the mine roof.

BACKGROUND OF THE INVENTION

Mine roof supports of the type mentioned above are frequently arranged such that the roof engaging canopy can tilt with respect to the base, to cope with various conditions and angle of roof. If however the angle of tilt becomes excessive, a dangerous situation can result, and it is known to provide devices to monitor the angle of tilt.

However, the known devices are somewhat limited. They comprise simple on/off devices which simply indicate whether or not the canopy has reached a particular angle with respect to the horizontal.

We have now developed a mine roof support which is much more sophisticated and versatile.

SUMMARY OF THE INVENTION

According to one aspect of the invention, a mine roof support is provided having a floor engaging base and a roof engaging canopy, there being means to monitor both the angle of the canopy and the angle of the base with respect to a datum. Mine roof supports frequently have to operate on a base which is itself inclined, if the seam of coal or other mineral is at an angle to the horizontal. A critical factor with respect to mine roof support safety is that the canopy should not exceed a certain angle with respect to the base. If both canopy angle and base angle are monitored, then any mechanism controlling the angle of the canopy can be made to allow for the fact that the base is also at an angle to the horizontal.

The means for monitoring the angle of the base and/or the canopy may comprise a tilt switch. The tilt switch may for example be a gravitationally controlled pendulum switch.

Angles may be monitored directly, or they may be monitored by monitoring the angle of a component connected to the base or canopy, means being provided for calculating the angle between the component and the base or canopy.

According to a second aspect of the invention, a mine roof support is provided, having a base and a canopy, there being means to monitor the angle of the base and/or canopy relative to a datum, the monitoring means comprising a transducer which produces a signal proportional to the angle being monitored.

With such a mine roof support, it is possible to obtain much greater information about the angle of the canopy and/or base. Instead of merely knowing whether or not the canopy and/or base has reached a predetermined position, information can be received continually about the angle of the canopy and/or base as the mine roof support operates.

Means may be provided to control the mine roof support in dependence upon information received about the angle or angles.

The control may be manual or automated.

The transducer may comprise a body member and a shaft member arranged such that movement of the base and/or canopy brings about rotation of the shaft with respect to the body member, there being means to detect this rotation.

The rotation may be detected by use of a rotary potentiometer.

The movement may be detected by the use of a rotary encoder.

The rotation of the shaft with respect to the body member may, for example, be brought about by mounting the body member on the canopy and/or base and suspending a pendulum from the shaft.

Alternatively, the rotational movement may be brought about by attaching one of the components, for example the body member, to the base and/or canopy and attaching the other component, for example the shaft, to a part which rotates with respect to the base or canopy when the base or canopy tilts. Such a part may comprise a shield member or linkage member, these parts commonly being used on mine roof supports.

Where it is necessary to monitor the angle between two portions which pivot with respect to one another, for example two components of a pivotal linkage interconnecting the base and canopy, special transducer arms may be connected between the components, the arms being arranged to bring about rotation of a shaft with respect to a rotary potentiometer or encoder, when the links pivot with respect to one another.

The invention includes any mine roof support to which angle monitoring means may be fitted, for example 2 and 4-leg mine roof supports.

The invention includes angle monitoring means for attachment to an existing mine roof support to provide a mine roof support according to the invention.

BRIEF DESCRIPTION OF THE DRAWINGS

By way of example, specific embodiments of the invention will now be described, with reference to the accompanying drawings, in which.

DETAILED DESCRIPTION OF THE INVENTION

Figure 1A:
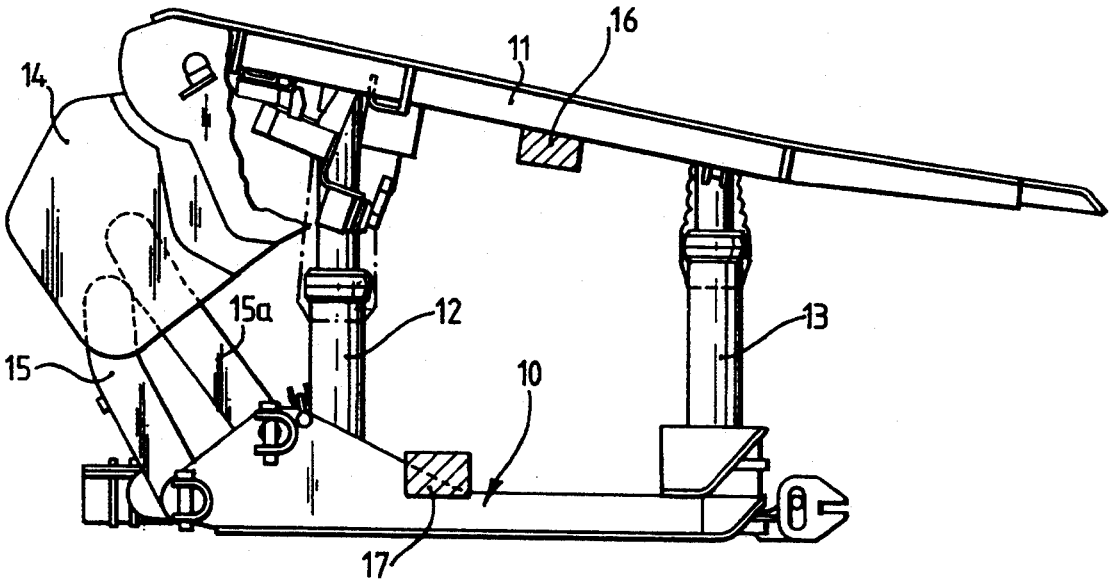
FIG. 1A is a side view of a first embodiment of mine roof support according to the invention.
Figure 2:
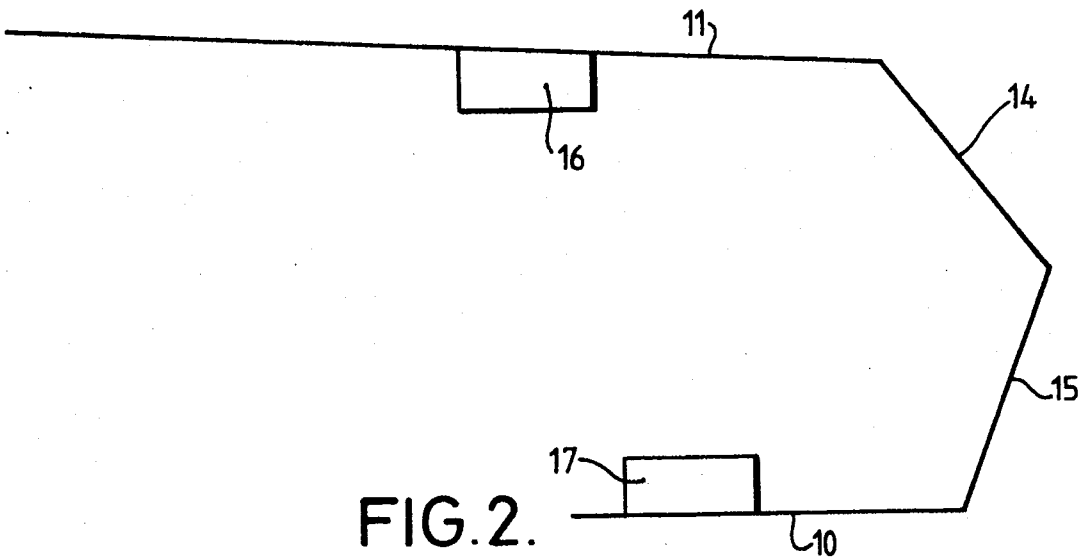
FIG. 2 illustrates diagrammatically the way in which tilt is monitored in the embodiments of FIG. 1A and 1B.

Considering firstly FIGS. 1A and 2, there is shown a 4-leg hydraulic mine roof support comprising a floor engaging base 10 and a roof engaging canopy 11. Pairs of hydraulic jacks or "legs" 12 and 13 extend between the base and the canopy for use in urging the canopy into a position in which it supports a mine roof.

The hydraulic jacks 12 and 13 can extend by differing amounts, as shown in FIG. 1A, and the canopy 11 is thus capable of tilting, to cope with varying mine roof shapes and conditions.

At the rear of the support, the base and canopy are interconnected in a conventional manner by a lemniscate linkage 15 and 15*a*, and a shield member 14.

If the canopy 11 tilts too much, with respect to the base 10, the support may become unstable and may collapse, or cause operational mining problems.

According to the invention, a first tilt transducer 16 is attached to the canopy. This transducer will measure the angle of the canopy with respect to a datum. The transducer may be gravity controlled, which means that the angle of the canopy 11 will be measured with respect to the horizontal.

It is highly desirable to know the angle of the canopy 11 with respect to the base 10 but since the base 10 may itself be operating at an angle to the horizontal, measuring the angle of the canopy with respect to the horizontal is not necessarily helpful.

In this embodiment of the invention a second transducer 17 is mounted on the base so that the angle of the base can also be measured and compensation can be made if the base is at an angle. There may for example be electronic control apparatus which will measure both angles and from this will compute the angle of the canopy with respect to the base.

Figure 1B:
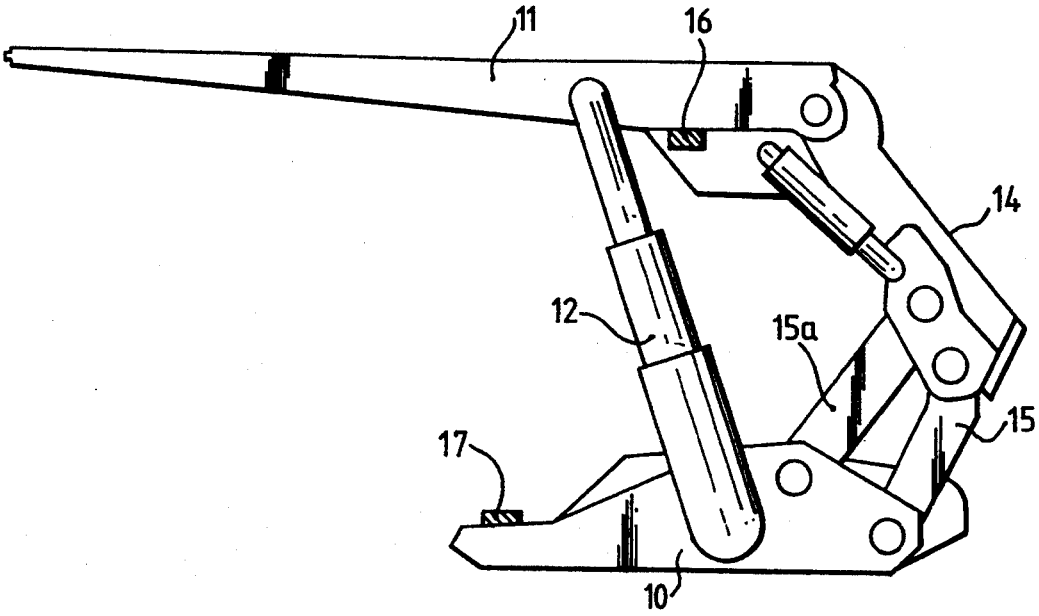
FIG. 1B is a side view of a second embodiment of the invention.

FIG. 1B shows an alternative embodiment of the invention which incorporates a mine roof support having "2-legs" i.e. one pair of hydraulic jacks extending between the base 10 and the canopy 11.

Components in FIG. 1B which are identical to those of FIG. 1A are designated by like numerals. The transducers 16 and 17 operate in like manner to those in the embodiment of FIG. 1A, and the monitoring of the base and canopy angles is performed in exactly the same manner as for that of the 4-leg support and will not be described in further detail.

Figure 3A:
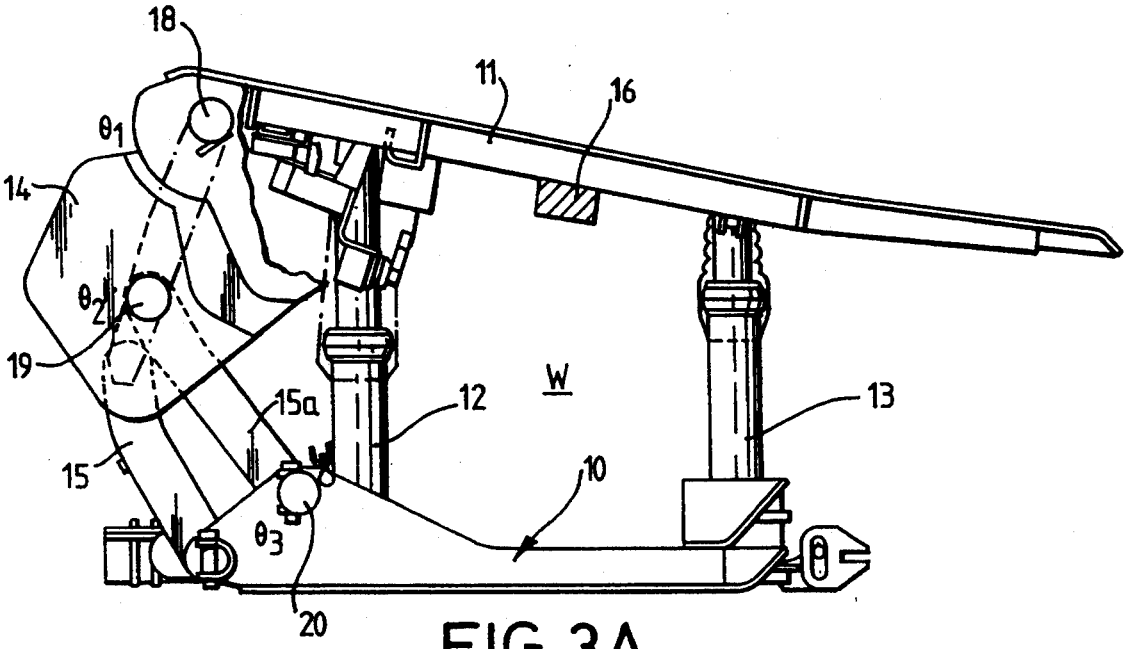
Figure 3B:
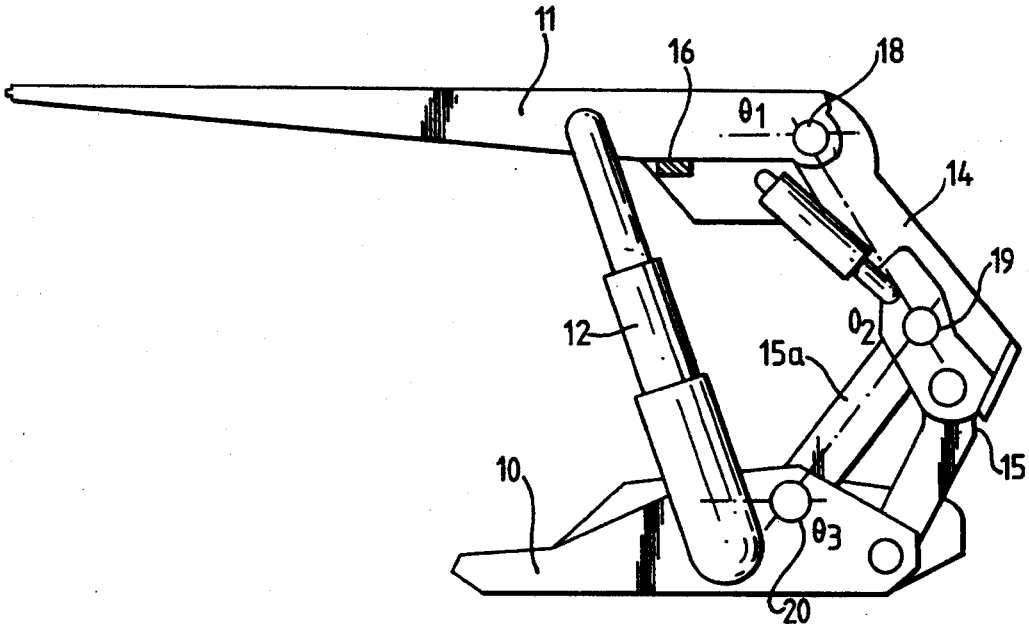

FIGS. 3A and 3B show 2 further embodiments, FIG. 3A showing a 4-leg support and FIG. 3B showing a 2-leg support, in which one tilt transducer 16 is mounted on the canopy but there is no transducer on the base 10. Instead, three angle transducers 18, 19 and 20 are used to measure the angle between the canopy 11 and the shield 14, the angle between the shield 14 and the link 15, and the angle between the link 15 and the base 10. From these three angles, the angle of the base with respect to the canopy can readily be calculated.

Figure 4:
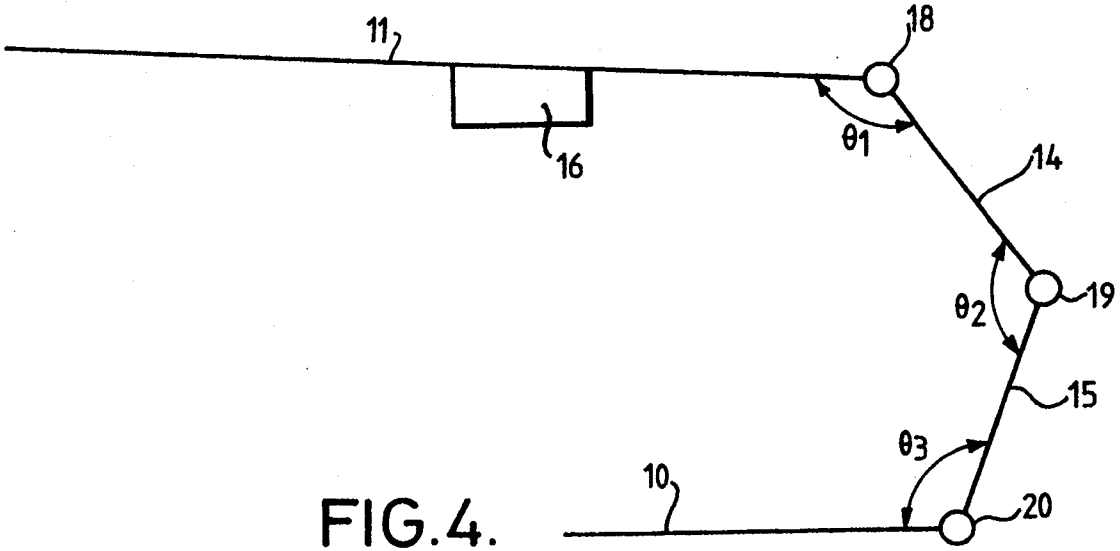
FIGS. 3A, 3B and 4 are views similar to FIGS. 1A, 1B and 2, but showing a third and fourth embodiment of mine roof support according to the invention.

FIG.4 is a diagrammatic representation of the embodiments of FIGS. 3A and 3B showing angles $\Theta_1$, $\Theta_2$ and $\Theta_3$, which represent the angle between the canopy and the shield, the angle between the shield and the link and the angle between the link and the base respectively. From these angles it can be shown that the angle of the base relative to the canopy is $\Theta_1$ plus $\Theta_3$ minus $\Theta_2$.

Figure 5A:
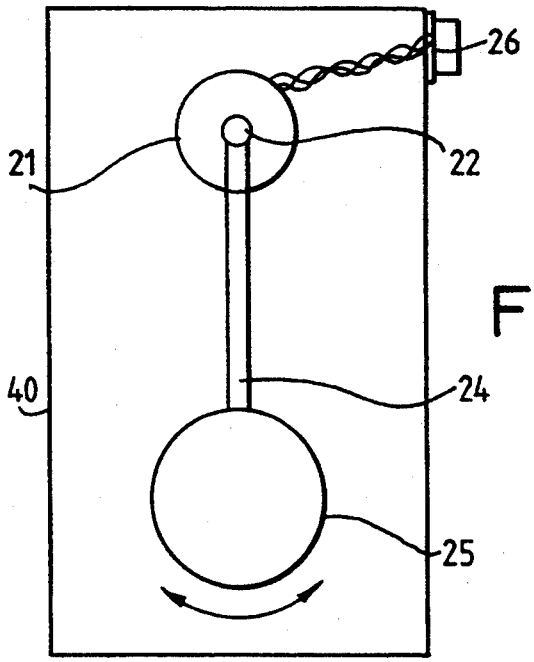
FIGS. 5A and 5B show one embodiment of tilt transducer.
Figure 5B:
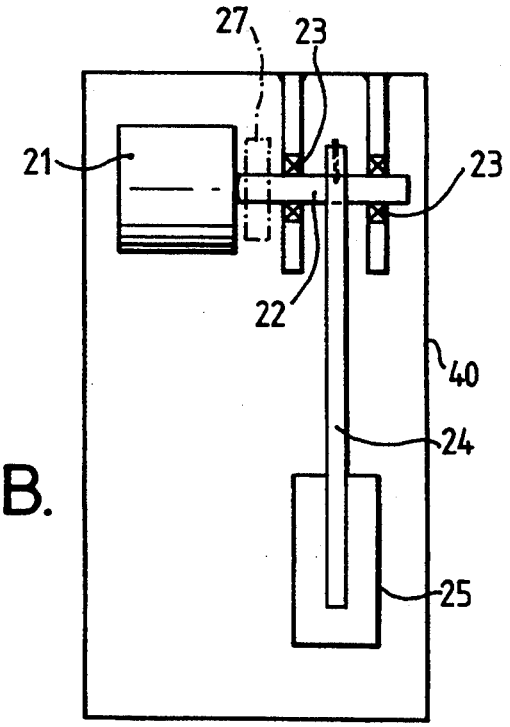

FIGS. 5A and 5B show one embodiment of tilt transducer, which could be used as the transducer 16 or 17.

Within a casing 40 there is mounted a body member 21. From this body member 21 projects a shaft 22. The shaft 22 rotates in bearings 23 and attached to the shaft is a pendulum 24 having a weight 25.

Within the body 21 is a rotary encoder or rotary potentiometer. When the casing 40, for example attached to the roof canopy, tilts, gravity causes the pendulum 24 to remain vertical. Thus the shaft 22 rotates relative to the encoder or potentiometer and this produces an electrical signal which is taken by wiring to an external connector 26.

An optional damper may be provided at 27, or to the pendulum weight, to restrict violence of movement.

The casing 40 is provided with means to attach it to either the base or the canopy.

A rotary encoder or potentiometer is chosen dependent upon the way in which the signal is to be used. If a digital signal, for example a binary signal is required, then a rotary encoder would be used. If an analogue signal is required, then a potentiometer can be used.

The encoder or potentiometer would be arranged to exhibit minimum friction, in order to improve accuracy and reduce hysteresis.

The means for mounting the casing 40 on a mine roof support may be such that the angle of the casing can be adjusted with respect to the support. Thus if the support is to operate on a mineral seam which is inclined at an angle of ten degrees, then the angle of the casing 20 with respect to the support may be adjusted so that even though the support is inclined to the horizontal, the casing 20 is vertical in its datum position.

In the embodiment shown in FIGS. 3 and 4, the angles may be measured by placing rotary encoders or potentiometers at the existing pivot points of the mine roof support. However, this can lead to difficulties, particularly with the lemniscate links, because the pivot points between these links frequently have a degree of play, for well known reasons, and the degree of play can increase because of wear.

Figure 6:
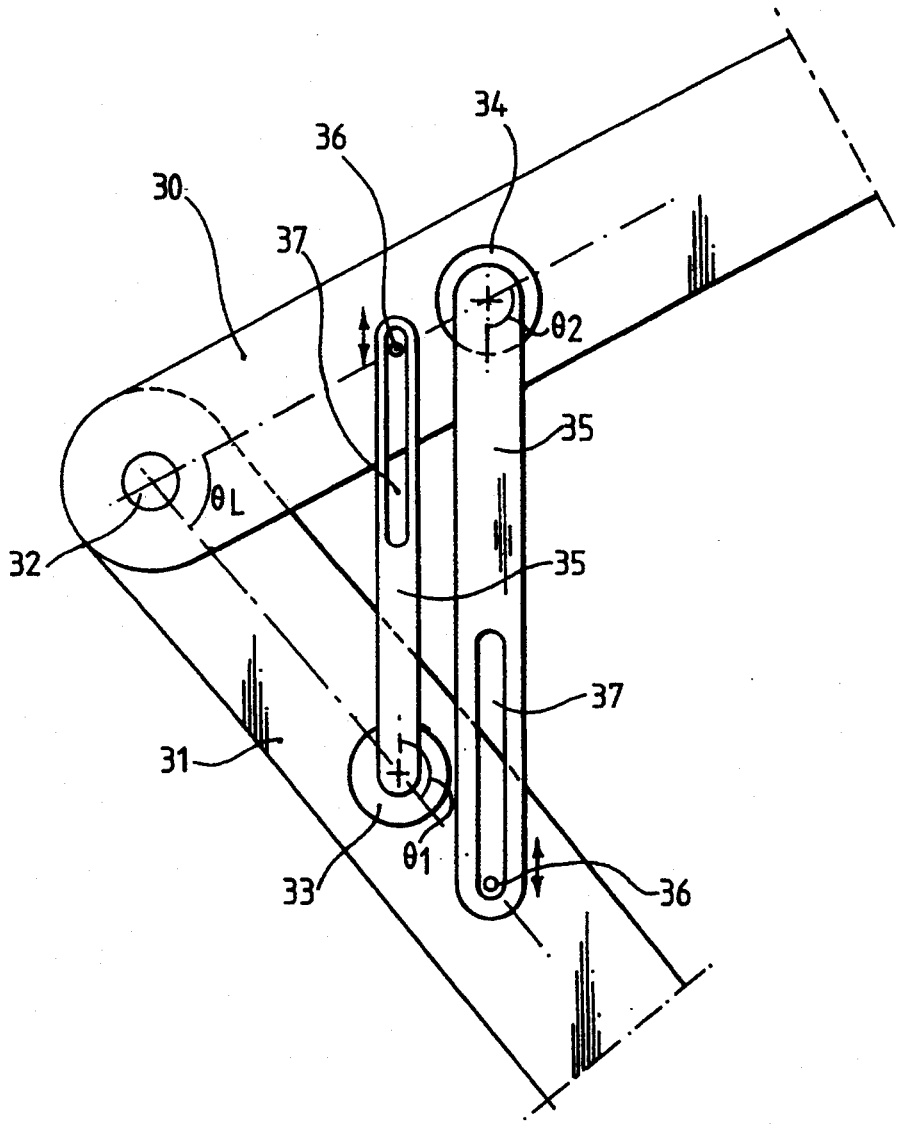
FIG. 6 shows an alternative embodiment of transducer.

The invention therefore provides a particular embodiment of angular transducer, which is highly suitable for measuring the angle between lemniscate links and other components of the mine roof support. This embodiment is shown in FIG. 6. Two components 30 and 31 are shown, pivotally connected together at 32. It is desired to measure the angle $\Theta_L$ between the components 30 and 31.

The first rotary transducer 33 is mounted on component 31 and a second rotary transducer 34 is mounted on the component 30. The shaft of each transducer has attached thereto a transducer arm 35. Each arm is caused to rotate when the components 30 and 31 pivot with respect to each other, by securing the far end of each arm 35 to one of the components. This securing is done by means of a pin 36 and slot 37 so that the arms do not prevent relative pivoting of the components 30 and 31.

Transducer 33 is used to measure angle $\Theta_1$. Transducer 34 is used to measure angle $\Theta_2$.

$\Theta_L$ equals 180 minus (180 minus $\Theta_1$) minus (180 minus $\Theta_2$).

Thus $\Theta_L$ equals $\Theta_1$ plus $\Theta_2$ minus 180.

Other configurations are possible and it may, for example, be possible to combine two transducers with one transducer arm.

The support according to the invention is particularly versatile. It can for example cope with working on an inclined seam, where the angle of the incline changes. The control system can automatically take into account the fact that the angle of the base is changing. If the support is working on a level floor, or a floor where the incline does not change, then detection of a change in the angle of the base can give a warning that the base is penetrating into the floor.

Since the support can provide an electronic indication of actual angle, the electronic control is greatly simplified. The canopy control algorithm can be simply changed by re-programming the required control angle.

Manual control means may be provided on the support, so that an operator can change the control parameters or carry out other operations. For example the operator may change the canopy angle control parameters in dependence upon changing working conditions, such as a change in the slope of the mining seam.

Alternatively, control means may be provided, for example within a computer, remote from the mining face, which automatically change the parameters or carry out other modes of control. For example, a computer may be arranged to sense a change in the angle of the base of the support, via a transducer monitoring the base, and then use this information to control the canopy.

It is highly desirable to ensure that the forward tip of the canopy is in contact with the mine roof. With the transducers described above, it is possible for an operator to pre-set the canopy to a predetermined angle, before the canopy is raised into contact with the roof, thus always ensuring that there is tip contact.

Being able to accurately monitor the angle of the canopy would also make it possible to provide for automatic cleaning off of fines which have built up on top of the canopy. Before the support is advanced to a new position, the angle of the canopy can be set up so that the fines are automatically swept off during advance of the support.

Information about angle can be used to control the hydraulic jacks independently, to cope with any given situation and to adjust the canopy to any desired angle.

The information can also be used to control the shearing machine which is removing mineral in front of the supports. If the information received from the supports suggests that the expected seam angle is not being followed, then the shearer can automatically be controlled to correct for the error.

A further use is in analysing underground strata or predicting bumps. By measuring the canopy and base attitudes, one can obtain a measure of the rate of convergence of the overlying strata by measuring the rate of any angular change while the roof support is stationary.

The embodiment using angular transducers in the rear links and rear shield can also be used to measure seam height and also therefore to measure convergence.

While the invention has been described with reference to 2 and 4-leg mine roof supports, it also extends to supports featuring any number of legs.

The reader's attention is directed to all papers and documents which are filed concurrently with or previous to this specification in connection with this application and which are open to public inspection with this specification, and the contents of all such papers and documents are incorporated herein by reference.

All of the features disclosed in this specification (including any accompanying claims, abstract and drawings), and/or all of the steps of any method or process so disclosed, may be combined in any combination, except combinations where at least some of such features and/or steps are mutually exclusive.

Each feature disclosed in this specification (including any accompanying claims, abstract and drawings), may be replaced by alternative features serving the same, equivalent or similar purpose, unless expressly stated otherwise. Thus, unless expressly stated otherwise, each feature disclosed is one example only of a generic series of equivalent or similar features.

The invention is not restricted to the details of the foregoing embodiment(s). The invention extends to any novel one, or any novel combination, of the features disclosed in this specification (including any accompanying claims, abstract and drawings), or to any novel one, or any novel combination, of the steps of any method or process so disclosed.

I claim:

1. A mine roof support suitable for use in a mine having a floor and a roof, said support comprising:

a floor engaging base;

a roof engaging canopy;

jack means extending between said base and said canopy for urging said canopy into contact with said roof;

first angle monitoring means located on said canopy for monitoring the angle of said canopy with respect to a datum and producing a first signal;

second angle monitoring means located on said base for monitoring the angle of said base with respect to a datum and producing a second signal; and means for producing a third signal in response to said first and second signals.

2. A mine roof support according to claim 1, wherein said angle of said canopy and said angle of said base are each monitored directly.

3. A mine roof support according to claim 1, wherein said first and second angle monitoring means comprise a tilt switch.

4. A mine roof support according to claim 3, wherein said tilt switch comprises a gravitational controlled pendulum switch.

5. A mine roof support according to claim 1, wherein said first and second angle monitoring means comprise a transducer.

6. A mine roof support according to claim 5, wherein said transducer produces a signal proportional to the angle being monitored.

7. A mine roof support according to claim 5, wherein said transducer comprises a body member and a shaft member such that movement of said base or said canopy causes rotation of said shaft with respect to said body member and wherein detection means are provided for detecting said rotation.

8. A mine roof support according to claim 7, wherein said detection means comprises a rotary potentiometer.

9. A mine roof support according to claim 7, wherein said detection means comprises a rotary encoder.

10. A mine roof support according to claim 7, wherein rotation of said shaft is caused by mounting said body member on said canopy or base and suspending a pendulum from said shaft.

11. A mine roof support according to claim 7, wherein a body member of a base angle monitoring transducer is attached to a first part of the mine roof support and the shaft is attached to a second part of the support.

12. A mine roof support according to claim 11, wherein said first part is the base of the support and said second part is a linkage member.

13. A mine roof support according to claim 7, wherein a body member of a canopy angle monitoring transducer is attached to a third part of the support and the shaft is attached to a fourth part of the support.

14. A mine roof support according to claim 13, wherein said third part is the canopy and the fourth part is a shield member.

15. A mine roof support according to claim 7, wherein said transducer is provided with an arm member which is linked to the shaft member.

16. A mine roof support according to claim 15, wherein the body member and arm member of said transducer are mounted on different portions of the mine roof support, and relative movement of the portions causes movement of the arm member and rotation of the shaft.

17. A mine roof support according to claim 16, wherein the different portions comprise first and second components of a pivotal linkage interconnecting the base and the canopy.

18. A mine roof support according to claim 17, wherein a body member of a first transducer and an arm member of a second transducer are connected to the first component, and an arm member of the first transducer and a body member of the second transducer are connected to the second component.

19. A mine roof support according to claim 1, wherein control means are provided for controlling the support in dependence upon information received about each angle.

20. A mine roof support according to claim 19, wherein said control is automated.

21. A mine roof support according to claim 1, wherein the support comprises one or more pairs of hydraulic jacks extending between the base and the canopy.

* * * * *